United States Patent [19]

Grossenbacher

[11] Patent Number: 5,052,459

[45] Date of Patent: Oct. 1, 1991

[54] COVERING FOR COVERING AN OPENING

[76] Inventor: Marco G. Grossenbacher, Engestrasse 1, CH-3012 Bern, Switzerland

[21] Appl. No.: 455,341

[22] PCT Filed: Mar. 6, 1989

[86] PCT No.: PCT/EP89/00226

§ 371 Date: Dec. 20, 1989

§ 102(e) Date: Dec. 20, 1989

[87] PCT Pub. No.: WO89/09322

PCT Pub. Date: Oct. 5, 1989

[30] Foreign Application Priority Data

Mar. 23, 1988 [CH] Switzerland ..... 1094/88

[51] Int. Cl.[5] ..... E06B 9/08

[52] U.S. Cl. ..... 160/122; 160/85; 160/201

[58] Field of Search ..... 160/122, 85, 86, 201, 160/120, 265, 266, 268.1, 274

[56] References Cited

U.S. PATENT DOCUMENTS

| | | | |
|---|---|---|---|
| 740,929 | 10/1903 | Sapp | 160/122 |
| 1,841,126 | 1/1932 | Indeck | 160/122 |
| 2,200,329 | 5/1940 | Derman | 160/122 X |
| 2,767,787 | 10/1956 | Miller | 160/201 X |
| 2,827,118 | 3/1958 | Wendt | 160/201 X |
| 3,308,872 | 3/1967 | Smith | 160/120 |
| 3,814,493 | 6/1974 | Radke | 160/201 X |
| 3,837,041 | 9/1974 | Modert et al. | 160/201 X |
| 4,096,902 | 6/1978 | Junod | 160/122 |

FOREIGN PATENT DOCUMENTS

| | | | |
|---|---|---|---|
| 8704485 | 7/1987 | World Int. Prop. O. | 160/120 |

*Primary Examiner*—David M. Purol

[57] ABSTRACT

A divided flexible covering (1,2)serves to expose any desired region of a surface or opening while masking the other regions. Two gripping slats (3,10) are located respectively at the beginning of a length of fabric (1 or 2) or at the beginning and end of at least one or two strips (4 or 8), each of which is guided endlessly over four rollers (5,9) or sliding blocks (47). Each length of fabric (1 or 2) is provided with an end piece (7 or 12). The length of the lengths of fabric (1 or 2) is approximately half that of the strips (4 or 8). The end pieces (7, 12) are mutually offset and are provided with a slot (14*a*) or are attached to a rod (43) provided for the other length of fabric, so that when a covering part (1), for example, is pulled down over the center of the cupboard, the covering part (2) is pulled simultaneously because one end piece (7) entrains another end piece (12) upward in the direction of traction. The operations are indentical in the opposite directions. The gripping slats (3 and 10) and the end pieces (7 and 12) for unattached strips (4 and 8) have slits which ensure frictionless sliding.

15 Claims, 11 Drawing Sheets

COVERING FOR COVERING AN OPENING

The invention relates to a covering for covering an opening or lining a surface with a web of flexible material.

BACKGROUND OF THE INVENTION AND RELEVANT PRIOR ART

Like long-known roller blind systems, such covering has the disadvantage that the removal of articles from certain parts of the cupboard unit—for example from those which are located in the region which faces away from that edge of the covering which borders the opening—inevitably involves complete opening of the covering. However, this is often undesirable since, for example, it takes more time than, for example, opening a cupboard door which is fastened to hinges and indeed also makes all areas of the cupboard accessible. This is the case regardless of whether the roller blind is operated by hand or by an electric motor, as described in German Offenlegungsschrift 3,531,675.

For lining surfaces, coverings in the form of wall carpets for example Gobelin tapestries, as well as curtains are also known and can be raised or lowered by means of tapes guided by pulleys.

Such coverings have been disclosed, for example, for cupboard units or their front coverings and are distinguished by their small space requirement during opening and by a stylish shape. German Offenlegungsschrift 3,531,675 describes such a cupboard unit.

The known designs of front coverings for boxes, for example according to the stated German Offenlegungsschrift, permit the covering to be left partly open, with the effect of displaying articles behind the covering in the cupboard unit for a longer time. However, in the areas described above, which face away from that edge of the covering which borders the opening, this is possible only by complete opening of the coverings. Consequently, the other areas cannot be hidden or concealed.

The same also applies to curtain or roller blinds, all of which allow a partial opening to be left only below their lower edge (or only to the side of the lateral edge). If it is desired, for example, to allow sunlight to enter a room through a window opening, this is possible only with simultaneous visual exposure of the lower part of the window.

Divided roller blinds have also been disclosed (for example in German Patents 211,972, 221,575 and 549,678). These roller blinds permit partial display, for example for the middle area—i.e. the section between those two edges of the two roller blind parts which border the opening—of the cupboard unit which they close. However, for the sections which are remote from the stated edges, the disadvantage mentioned above is applicable. Moreover, these roller blinds are however connected to one another by means of ropes or chains in such a way that they can only be moved in conjunction with one another. Opening the upper roller blind in an upward direction automatically results in opening of the lower roller blind in a downward direction; the objects of the invention therefore cannot be fully achieved by such a known design.

On the other hand, connection of the upper and lower roller blinds is necessary since, in the known designs, it is necessary to prevent automatic opening or closing of the roller blinds through their own weights.

Divided cupboard units are also known, in which in principle a cupboard unit with an upward-opening roller blind is provided at the top and a cupboard unit with a downward-opening roller blind is provided at the bottom—the two roller blinds being separate from one another. It is true that such embodiments are somewhat better with regard to the independence of opening, since the upper roller blinds can be moved independently of the lower roller blinds; in the end, however, they merely constitute a doubling of a cupboard unit according to German Offenlegungsschrift 3,531,675 (one of them positioned upside down), which requires a greater amount of material but nevertheless only partly achieves the objects of the invention.

OBJECTS AND STATEMENT OF THE INVENTION

An object of the invention is partial opening of the covering.

It is thus a further object of the invention to provide a covering which permits partial opening or display of areas behind, regardless of the position of these areas and without it being necessary, in the case of certain areas, to open the cupboard unit or the covering completely, and, in the case of the display of certain areas, without it being necessary also to present or expose other areas.

All objects of the invention are achieved in a surprisingly simple manner by the combination of the following features:

The covering consists of a web of flexible material, which web is formed into a continuous closed system by tension means at both sides of the covering. The tension means is guided via pulleys, wherein the covering consists of two parts, for each of which a tension means is provided at both sides of the covering part. Each tension means has tension elements connected exclusively to the covering part that is coordinated with it. Each covering part is capable of movement independently of the other covering part and the tension elements connected to the other covering part. Each covering part is capable of being fixed in any desired position. At least two pulleys are provided at both sides of a covering part with which the pulleys are coordinated, nonrotatably connected to one another and designed for slip-free transmission of tension to the tension means.

The invention permits alternative opening, closing or partial opening or concealing or exposure of any areas behind, without unintentionally displaying other areas. For the purposes of the invention, suitable coverings include the following structural elements: doors made of windable material (the material is understood as being any flexible material—stretchable or non-stretchable), roller blinds, chain-link webs, flexible photographic or illustrated panels, projection screens, venetian blinds, wall linings, room dividers, etc..

The divided covering, the parts of which can be moved independently of one another, also permits decorative modification if the the two parts of the covering are, for example, of different colors or have different designs.

If required or desired, the lower or upper part of the covering may predominate and, in the extreme case, may even constitute the entire covering. Combinations of, for example, transparent covering parts make it possible to achieve a wide range of effects by overlapping of the covering parts.

The tension means ensures that the ends of the coverings or of the covering parts are each parallel so that, regardless of the instantaneous position of the two parts, linear tension of the covering, in the direction of movement, is maintained. Transmission of force between the parts of the tension means at both sides of the covering is ensured to such an extent that tension applied manually—regardless to which part of the grip bar—leads to reliable, uniform rolling and unrolling of the relevant part of the covering. This is one of the most important effects of the invention since it ensures that the covering is never tilted.

Advantageous additional features of the invention are described in the preferred embodiments and set forth below.

The covering parts consist of a material which is elastically stretchable only in an opening direction and is substantially non-stretchable at right angles to the opening direction. The tension means consist of tape-like elements which are guided via a first group of four pulleys that form a closed system. And the first group of four pulleys are covered with a friction cover. The tape-like elements are guided by a second group of four pulleys for a total of eight pulleys, four pulleys adjacent to the covering part with which they coordinate and four pulleys adjacent to the other covering part. These features always ensure a smooth covering which gives the same neat impression regardless of the opening state. The design of the tension means permits completely independent tensioning of the covering with respect to the tension means.

The covering parts are guided over rollers. The pulleys which are non rotatably connected to one another are pulleys by which the particular covering part is guided while other pulleys are rotatably mounted independently of one another. The non-rotatably connected pulleys are non-rotatably connected with rollers and the independentably mounted pulleys are rotatably mounted independently of the rollers. These features guarantee the above-mentioned straight movement of the covering.

Each covering part has a grip bar at its front end and an end piece at its rear end. The tension means of one covering part can glide freely in recesses in the grip bar or end piece of the other covering part. The rear ends of the two covering parts have their end pieces in each case on the other side of the end piece of the other covering part and are prevented from gliding past one another. These features permit the interaction of the two covering parts in that complete covering with one covering part simultaneously and automatically leads to complete retraction of the other covering part.

The covering parts are guided over rollers, and at least one of the rollers is in the form of a take-up roller and is arranged on a shaft away from the pulleys nonrotatably connected to one another. The take-up roller is subjected to tension with respect to the shaft by a spring in the winding direction. And, the grip bar is guided laterally with braking means, in at least one rail. These features describe a variant in which rolling up of the covering takes place in a simple manner—similarly to a roller blind—so that it is necessary to employ only very little force during opening of the covering. It may also be possible to provide a known catch mechanism, which is therefore not described in detail, and which effects automatic opening—under the force of the spring—by a procedure in which, for the purpose of opening, a brief jerk is effected in the closing direction and the covering is then released.

Another advantage of the embodiment according to these features is the reduced space requirement. In this embodiment, there is no need to guide either the end of the covering or the tension means in the rear area, for example of a box. In such a case, the tension means can be limited to the use of 4 pulleys (2 at the top and 2 at the bottom), whereas otherwise 8 pulleys are usually used (2 at the top front, 2 at the top rear, 2 at the bottom front and 2 at the bottom rear per covering part). Such a variant is also most suitable for room dividers, curtain constructions, etc..

The covering parts are guided via guide pieces which are in the form of cylindrical segments and have an antifriction coating. An economical simplification is described by these features. Such guide pieces may be made of bench sheet metal or, for example, of plastic injection moldings.

The tension means consist of a non-stretch material. And the tension means run at least partly in rails which are lined for braking at least the grip bars or the end pieces. This describes a practical embodiment in which the tension means is completely concealed, and, in the case of a take up roller embodiment, a suitable brake is provided which is capable of absorbing the force of the spring, so that a covering remains in its preselected position despite spring tension.

The covering parts in an open state are each wound on a take-up roller mounted on a shaft. The take-up roller has a tension apparatus between the shaft and the roller for tensioning the covering parts with respect to the tension means. The tension means and pulleys coordinated with a take-up roller are nonrotatably connected to the shaft. This embodiment represents a self-regulating tensioning apparatus for the particular covering part. Regardless of the amount of rolled-up covering web and regardless of temperature and other external influences, the tension between the roller and the grip bar is always kept constant. This tension can moreover be adjusted by detaching the covering from the roller, rotating the roller against the force of the spring (in the winding direction of the covering) and then attaching the covering to the roller again. A precondition for satisfactory functioning of this tensioning apparatus for the covering is of course that the tension means is stress-free. Alternatively, it is also possible to vary the fastening point of the covering to the tension means or tapes. It is fixed there, for example, via a grip bar by means of clamping screws.

More than two covering parts are provided. One pair of the covering parts in each case is mounted in a moveable frame. The grip bars and the end pieces of the covering parts are capable of gliding past one another, so that at least partial overlap of the covering parts can be obtained.

The moveable frames are laterally displaceable relative to one another in rails. This embodiment is used in particular for room dividers or wall linings or window coverings. A very high degree of flexibility is ensured.

At least a part of the covering is image-reflecting. This feature is suitable for use in, for example, cinema halls or audiovisual apparatuses.

DESCRIPTION OF THE DRAWINGS

In the drawings.

The Figures are described in relation to one another; identical parts bear identical reference symbols; similar parts bear similar reference symbols with different indices.

DETAILED DESCRIPTION

Although essentially doors made of roller blind material are presented, the invention is, however, not restricted to doors but also comprises purely stylistic structural elements, such as curtains, room dividers, wall linings, stage sets, Gobelin tapestries and advertisements, and possibly also audiovisual aids, such as projection surfaces, shields for welding areas or the like.

Two covering parts 1, 2 are always used together, although it is not necessary for both parts always to be visible, as will be explained later. One covering part 1 is to be closed from above and the second 2 from below. However, the invention also relates to two covering parts running sideways (one from the left and one from the right). Moreover, the invention also relates to a plurality of front covering parts one on top of the other even though, for presentation reasons, only one position is generally shown.

As shown in FIGS. 1 to 6 and 31 to 34, it is an object to achieve as different design effects or opening positions as possible.

Figure 1:
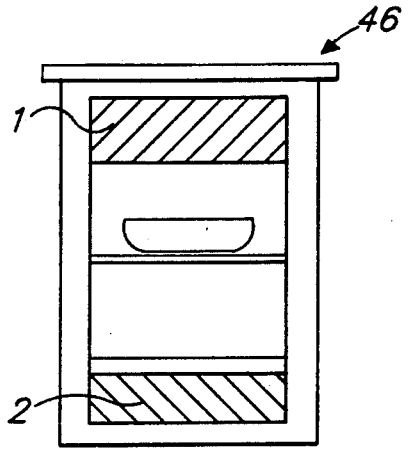
FIGS. 1 to 6 show a plan view of various positions of the covering according to the invention.
Figure 2:
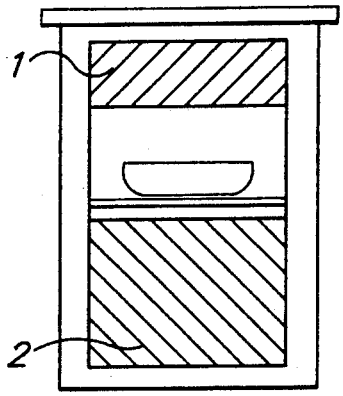
Figure 3:
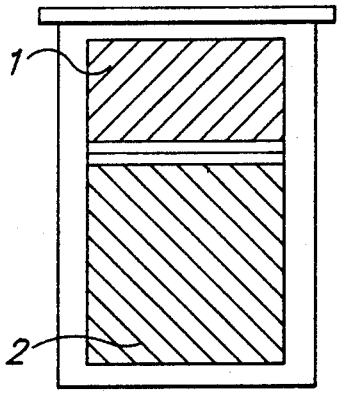
Figure 4:
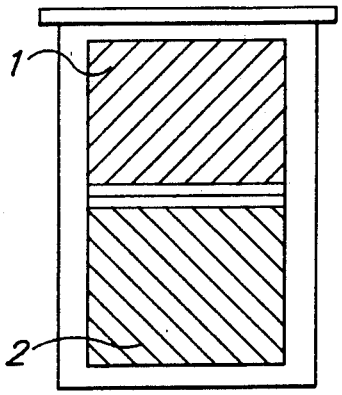
Figure 5:
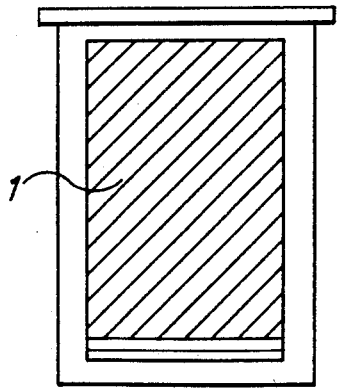
Figure 6:
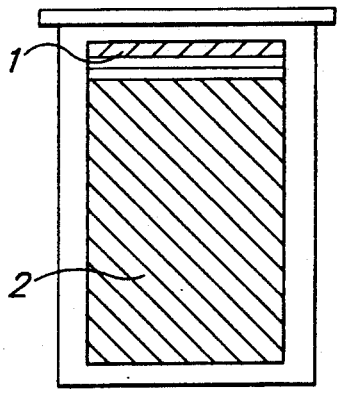
Figure 33:
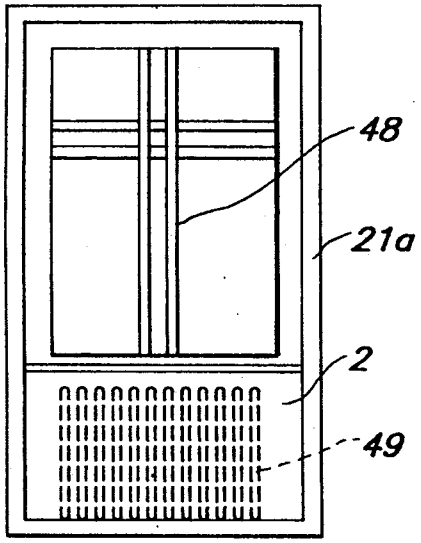

In FIG. 1, for example, the covering parts 1 and 2 are four-fifths open while in FIG. 2 they are closed, the lower covering part 2 being pulled further upward than part 1 has been pulled downward. In FIG. 3, the covering part 1 has been pulled fully down and part 2 is therefore no longer visible. In FIG. 4, the covering part 2 has been pulled up about half way and part 1 has been pushed slightly upward. In FIG. 5, both parts have been pushed or pulled about equally far toward the middle, and in FIG. 6 the entire cupboard opening is closed almost exclusively by covering part 2. FIGS. 31 to 34 indicate frames 21, 21*a* which hold covering parts 1, 1*a*, 1*b*, 2 according to the invention. In the left-hand part of FIG. 31, both parts 1, 2 are half open, while in the middle area part 2 is pulled up five sixths and only one sixth of part 1 is visible. In the right-hand area, part 2 overlaps part 1 by one fourth. Since part 2 is transparent, a combination of patterns 50 results. FIG. 32 shows a combination of 4 frames 21, the coverings 1, 2, 1*a*, 2*a* partially overlapping the frame 21 in that the frames 21 have been pushed one behind the other, while in the middle the frame 21 has been pushed to one side, providing free access 41. The covering part 1*b* of frame 21 immediately to the right has been pulled fully downward. It is in the form of a screen or projection surface. The frame 21 can be moved, for example, on rollers 51 (see FIG. 31); however, suspension arrangements are also possible. FIG. 33 shows a frame 21*a* which is pushed in front of a window 48. The covering part 2 conceals a radiator 49. In the heating season, at least part of the radiator 49 is exposed and the window 48 may be covered.

Figure 34:
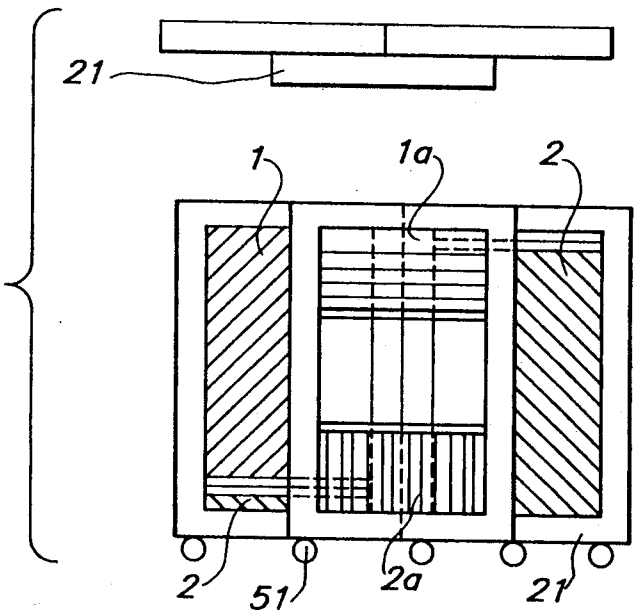
Figure 31:
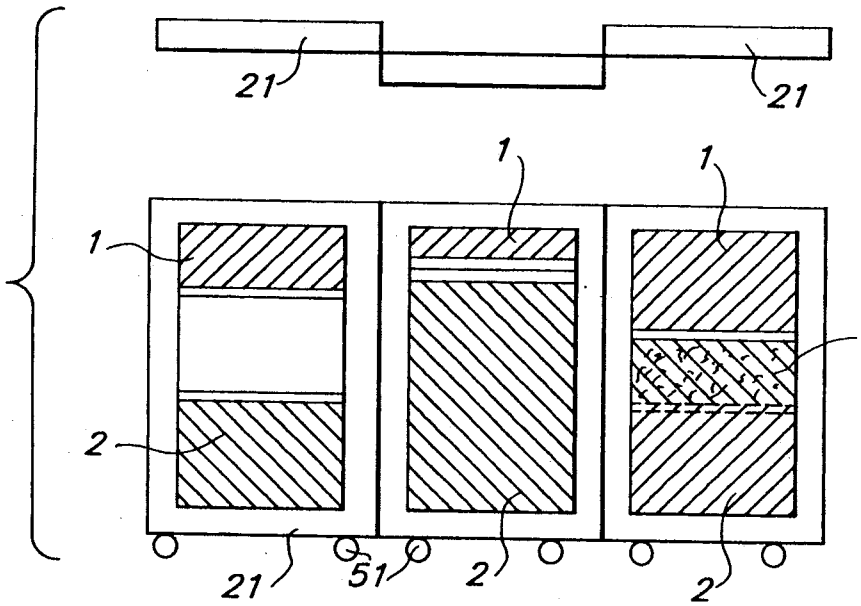
Figure 32:
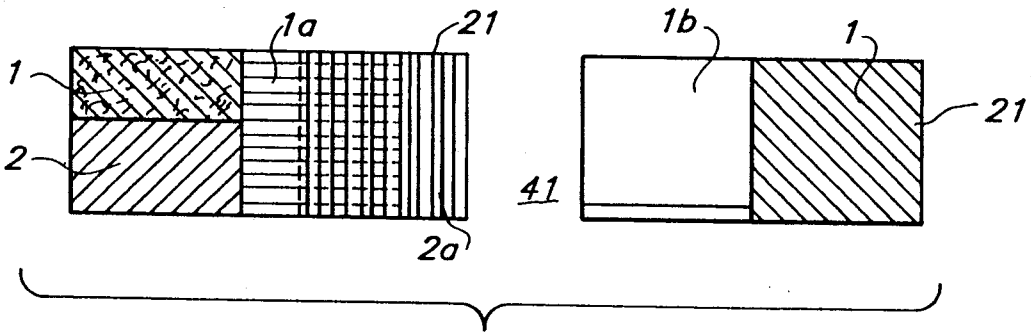

In FIG. 34, frames 21 according to FIG. 31 are moved relative to one another. Between the partly open covering parts 1*a* and 2*a* of the middle frame 21 and the adjacent parts 1 and 2 there is therefore partial overlap with novel design effects.

The mechanism can in principle be based on two different types. In both cases, there is an overlap of principles: Laterally guided continuous tapes 4, 8 which are connected to corresponding grip bars 3, 10 of the particular covering part 1, 2. As described below, the grip bars 3*c* and 10*c* (FIG. 30) are intended for fastening the particular covering parts 1, 2.

Figure 7:
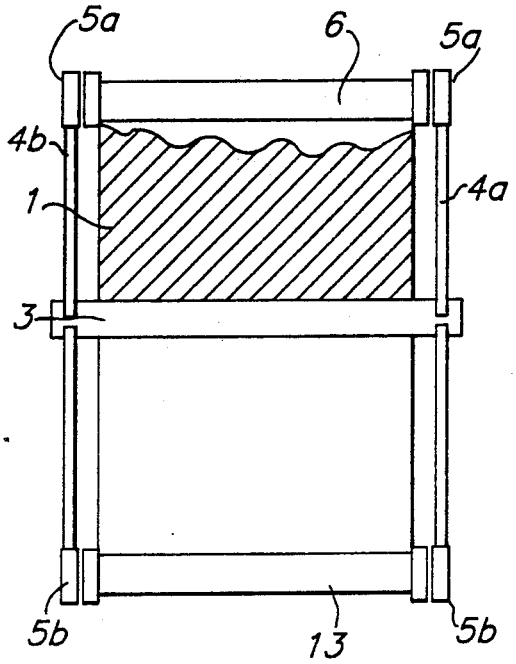
FIGS. 7 to 10 show details of the guidance of covering.

FIG. 7 shows the covering part 1 with the grip bar 3 and the two tapes 4*a*, 4*b*, the cupboard 46 and the lower covering part 2 being omitted. The tapes 4 are continuous tapes whose beginning and end are fixed to the grip bar 3. The tapes 4 are each guided via four pulleys 5*a*, *b*, as can be seen more clearly in FIG. 8, which is a side view of FIG. 7. At least the front pulleys 5*a*—preferably also the rear ones (5*a*)—are nonrotatably connected to one another, while the pulleys 5*b* are rotatably mounted.

Figure 8:
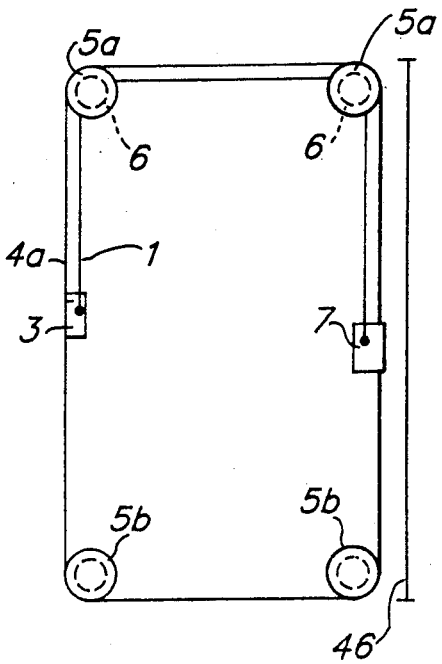
Figure 9:
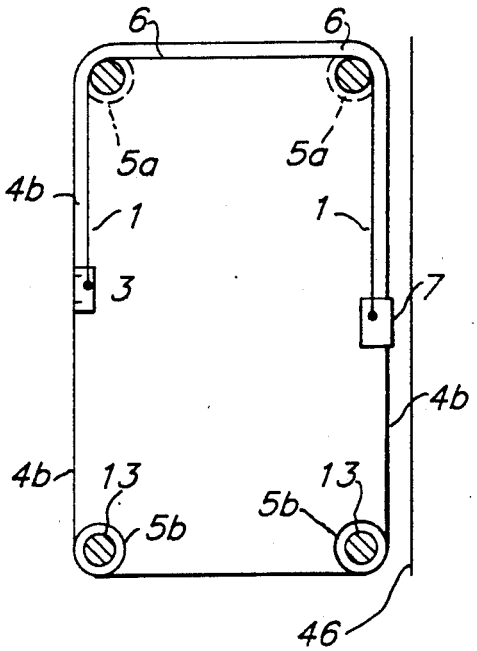

The material web of covering part 1 is fastened to the grip bar 3 and guided via two rollers 6 to the back wall of the cupboard 46, as can be seen more clearly in FIG. 9, which is a side view of FIG. 8, but without the tapes 4*a* and the pulleys 5*a* or 5*b* of the right-hand side. The rollers 6 are axially aligned with the pulleys.

In the region of the rear wall of the cupboard 46, the material web of covering part 1 ends at an end piece 7, which end piece 7 is also rigidly connected to the tapes 4*a* and 4*b*. The four tapes thus serve for tensioning and uniform movement of the material web or of the grip bar 3. If the grip bar 3 is, for example, pushed upward, the tapes 4*a* and 4*b* pull the end piece 7, and the latter thus pulls the material web of covering part 1 at the rear wall of the cupboard in a downward direction. The covering part 1 thus rolls over the rollers 6 and the tapes 4 roll over the pulleys 5, and the covering part 1 may also overlap the pulleys 5.

Figure 29:
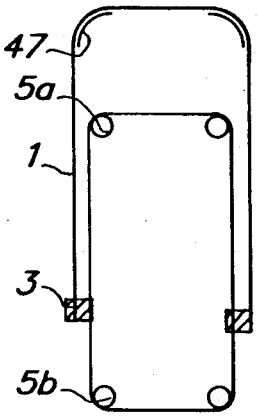
FIG. 29 shows a variant having glide pieces in the form of cylindrical segments.

Instead of the rollers 6 and pulleys 5, it is also possible to use surfaces having good frictional properties, for example teflon-coated arcs (hollow cylindrical segments) or the like (see FIG. 29). In such a case, the pulleys 5 may also be mounted a distance away from the segments 47. However, the desired range of movement of grip bar 3 is decisive here. At least for the tapes 4, however, properly mounted pulleys 5 having little resistance to rolling and high frictional resistance of the contact surface of the pulleys 5, which can be achieved, for example, by means of a rubber cover on the circumference of the pulleys 5, are preferred. The embodiment of the contact surface is critical for good force transmission from tapes 4 to the pulleys 5 and vice versa.

Figure 16:
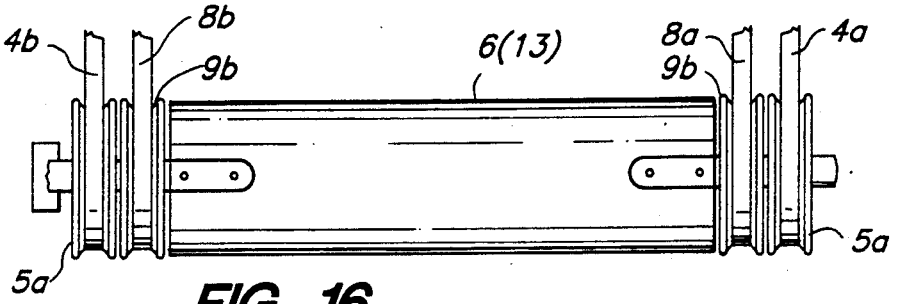
FIG. 16 shows details of a pulley and roller guide.
Figure 17:
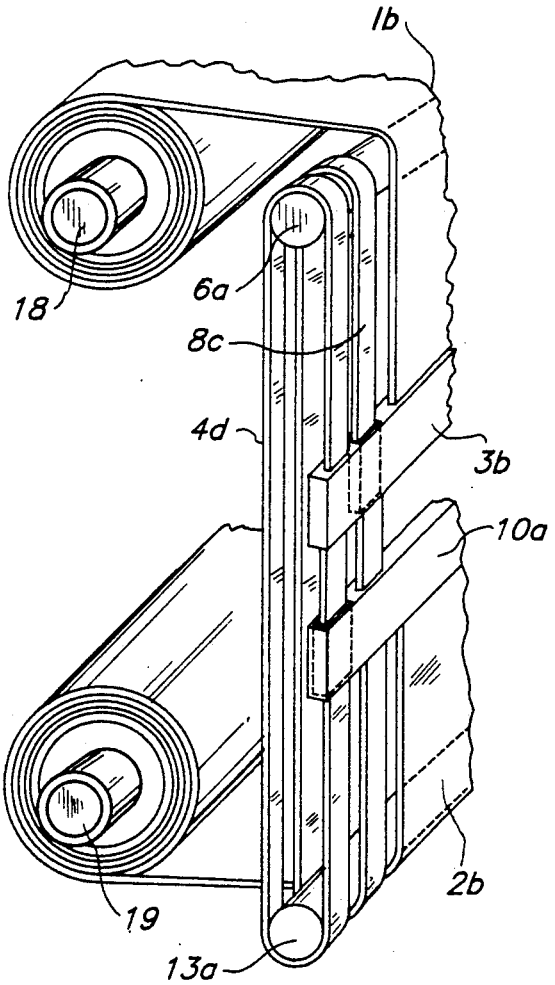
FIG. 17 shows a variant according to the invention, having parts of the covering which are mounted in the manner of a roller blind.
Figure 18:
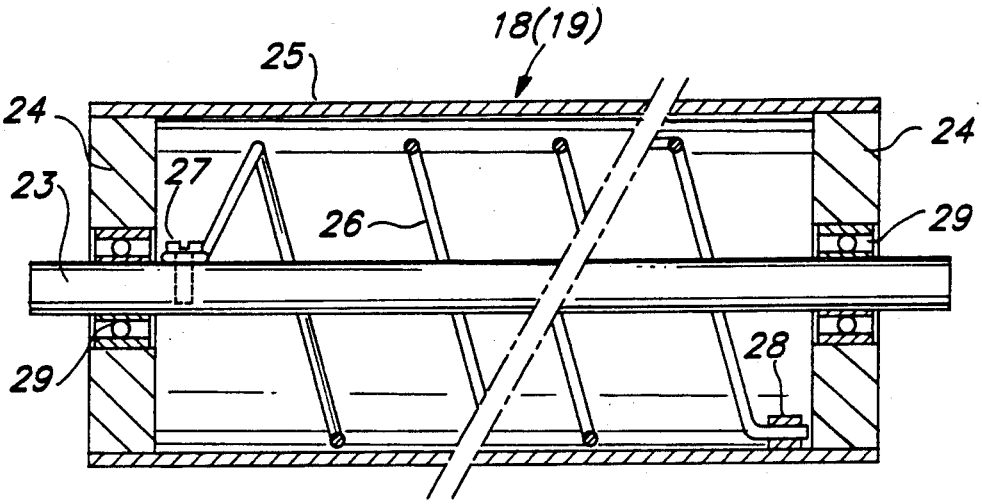
FIG. 18 shows a detail of the variant in FIG. 17.

The pulleys 5 are furthermore connected by means of a rigid axle, which is formed by the rollers 6, as can be seen more clearly in FIG. 16. Thus, rotation of a pulley 5*a* automatically leads to rotation of the other pulley 5*a* connected to it, and the tapes 4*a*, 4*b* consequently always run at the same speed, resulting in parallel guidance of the grip bar 3. FIG. 18 or 17 shows a variant whose pulleys 5*a* are not axially aligned with the roller, which is in the form of take-up roller 18. This is because this take-up roller 18 serves for automatic rolling up of the covering, and the pulleys 5*a*, 9*a* nevertheless must be non-rotatably connected to one another but the shaft 23 of roller 18 must be rigid in order to permit engagement by a spring 26, as will be explained below.

The covering part 2, with a grip bar 10, with tapes 8*a*, *b*, with pulleys 9*a*, *b*, with roller 13 and with an end piece 12, functions analogously to the covering part 1.

Figure 10:
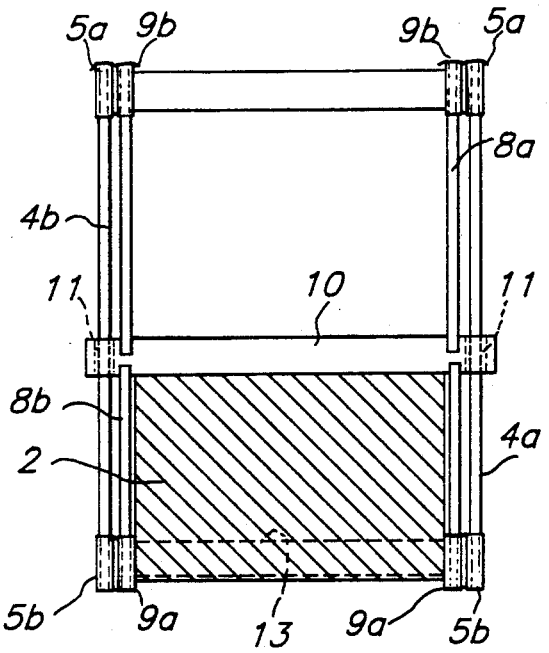

FIG. 10 is a vertical section showing the covering part 2 with its tapes 8*a* and 8*b* and the pulleys 9*a* and 9*b*. A grip bar 10 is firmly connected to the covering part 2, and also with the beginning and the end of tapes 8*a* and 8*b*. The tapes 4*a* and 4*b* slide through slots 11 in the grip bar 10. Such slots 11 are of course also present in the omitted grip bar 3. This firstly permits individual moving of covering parts 1 and 2. In this variant, however, this individual movement continues only until the grip bars 3 and 10 come to rest against one another, as shown in FIG. 9, or 1, 4 and 5 or 22 and 23. The pulleys 5*a* and 5*b* are shown on the outside or inside. However, since a pulley designated with a b always rotates freely and a pulley designated with an a is connected, it may also be expedient to arrange the pulleys 5, 9 alternately (FIG. 30), so that the upper and lower arrangements are merely rotated through 180 degrees, thus simplifying production.

In the region of the rear wall, the covering part 2 also has an end piece 12, which—as described below—interacts with the end piece 7 of covering part 1.

Figure 11:
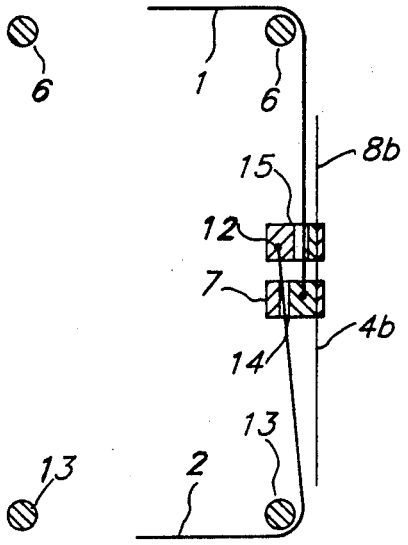
FIGS. 11 to 12 show details of end pieces and grip bars.
Figure 26:
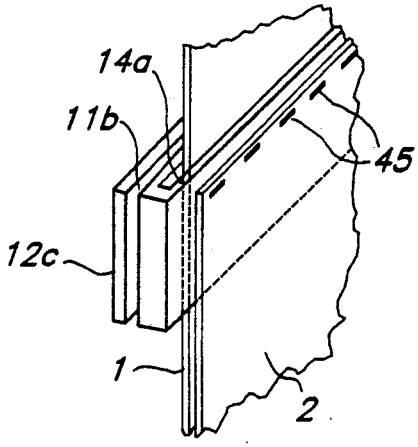
FIGS. 26 to 28 show variants and details of the end pieces.
Figure 27:
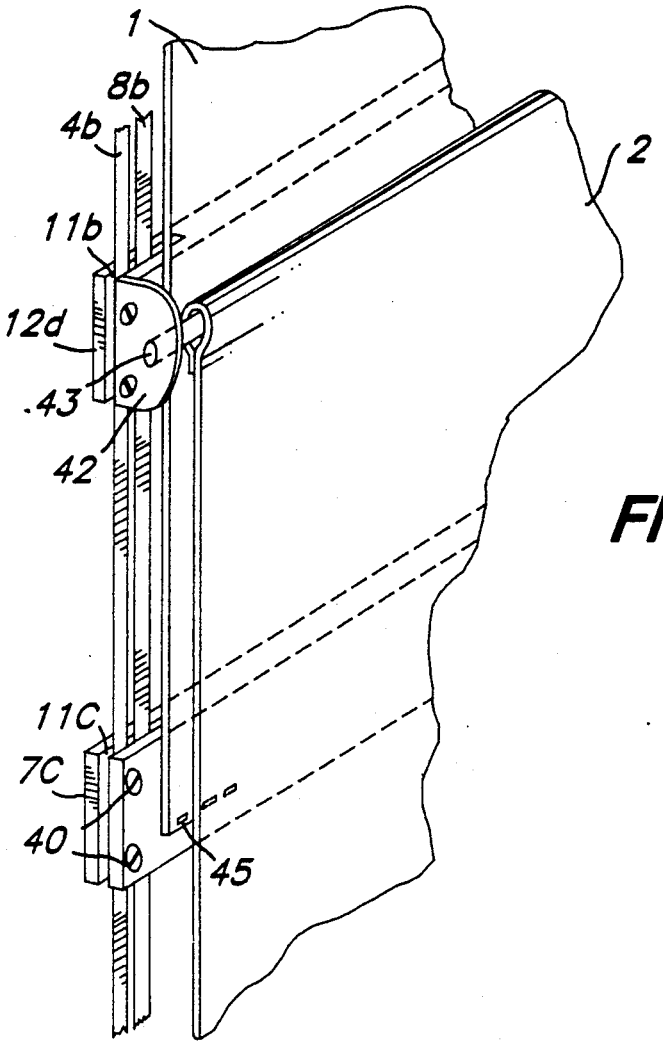

As shown in FIG. 11 and 26, at least one (preferably only one) of the end pieces 7 or 12 each has a longitudinal slot 14 or 15 for the other material web of the covering parts 1 and 2, so that the particular end pieces 7 and 12 of the other covering part 1 or 2 are on the other side of the other end pieces 12, 7. For the tapes 4 or 8, there is a slot 11*b*, *c*, (FIG. 27) in the end piece 7 or 12 of the other covering part 1 or 2, just as there is in the grip bars 3, 10.

Figure 12:
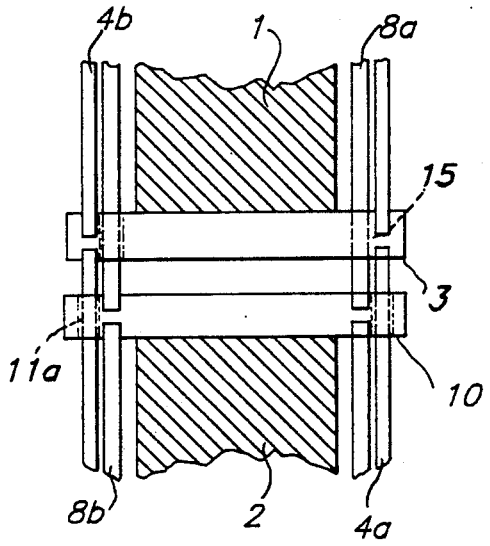
Figure 14:
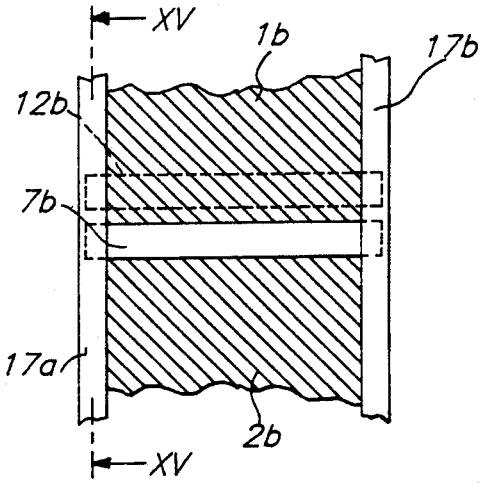
FIGS. 14 and 15 show a variant of the end pieces.

FIG. 12 shows the two grip bars 3 and 10, which also have feed-through slots 11 or 16 for the other tapes 8 or 4, respectively. The region of these feed-through slots 11 and 16 and the tapes 4 and 8 are of course concealed during operation by the front wall of the cupboard.

Figure 28:
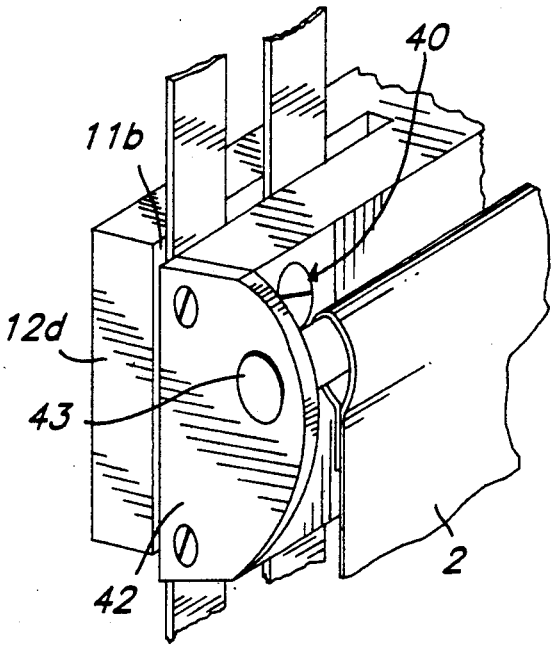

Alternatively to the longitudinal slots 14 and 15, it is also possible to provide a rod 43 (FIG. 27 and 28) which is held at each of its ends by a lateral part 42 a distance away from the end piece 12*d*. The other covering part 1 slides through this distance, while the covering part 2 is attached to the rod 43. In such a construction, the other end piece 7*c* may also be without a rod 43 or longitudinal slot, since the covering part 2 can slide past unhindered without this. The covering part 1 is fastened to the end piece 7*c* by means of staples 45. In the slots 11*b* or 11*c*, the tapes 8*b* or 4*b*, respectively, are fixed, while the tapes 4*b* or 8*b* glide freely.

In the embodiment just described, two grip bars 3 and 10 each therefore form the starting point of the covering parts 1 or 2 and the starting point and end point of at least one or two tapes 4 or 8, which are each guided continuously via four pulleys 5, 9 or via glide pieces which are not shown. The material webs 1 or 2 each end at end pieces 7 or 12.

It is sensible for the length of the material webs 1 or 2 to correspond roughly to half the length of the tapes 4 or 8.

The end pieces 7, 12 may be offset from one another, and they are provided with a slot 14*a* or with a rod 43 for the other covering part, so that when one covering part, for example 1, is pulled downward over the middle of the cupboard or of the opening or of the surface, covering part 2 is simultaneously pulled, in that the end piece 7 also forces end piece 12 upward in the direction of tension. The transmission of tensile forces functions in exactly the same way in the opposite direction.

The grip bars 3 and 10, like the end pieces 7 and 12, have slots 11*a* or 16 for the tapes 4 and 8 which are not coordinated or fixed. Alternatively, the grip bars and end pieces in the variants according to FIG. 30 to 34 are narrow and without slots. As is familiar to a skilled worker and therefore not described in detail, they run in different planes, permitting overlap or allowing them to slide past one another.

Figure 13:
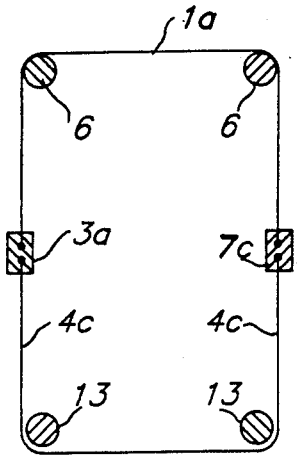
FIG. 13 shows a variant with half tape length.

With an appropriate selection of the material for the covering parts 1 and 2, which in this case is preferably non-stretchable, tapes 4 and 8 of only half the length in each case may also be sufficient, in that the associated tapes are omitted where the relevant material web runs. In this case—considered in the side view—the material web with the coordinated tapes would form a closed circle (see FIG. 13).

FIG. 14 and 20 to 23 (schematic) show a further variant in which the end pieces 7 and 12 are not formed with slots for the material web 1, 2 for the other covering parts but instead are guided laterally in rails, so that the driving movement of one end piece is ensured for the other in the case of the corresponding movement of the grip bars. The rails are designated by 17*a*, *b* in FIG. 14. However, the slots 11, 16 for the tapes must be provided in this case. They serve to guide the end pieces 7, 12 in this case.

Figure 15:
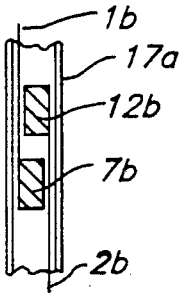

FIG. 15 shows a section through the rails 17*a* in the longitudinal direction. The tapes, which in this case also engage the end pieces 7*b* and 12*b*, are, however, guided analogously to the embodiment according to FIG. 11—not shown—in slots of the end pieces 12*b* or 7*b*. Although not shown in detail, it is expedient if the effective diameter of the pulleys 5 or 9 is identical to that of the roller 6 or 13 when the pulleys are non-rotatably connected to the roller.

Figure 30A:
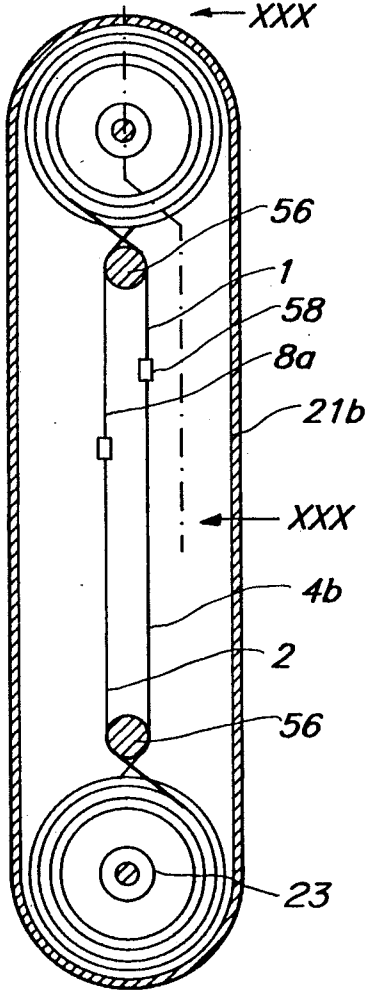
FIGS. 30 and 30*a* show a variant having an automatic tension means for the covering parts and FIGS. 31 to 34 show, in a stylized manner, variations with coverings which can be moved in frames.
Figure 30:
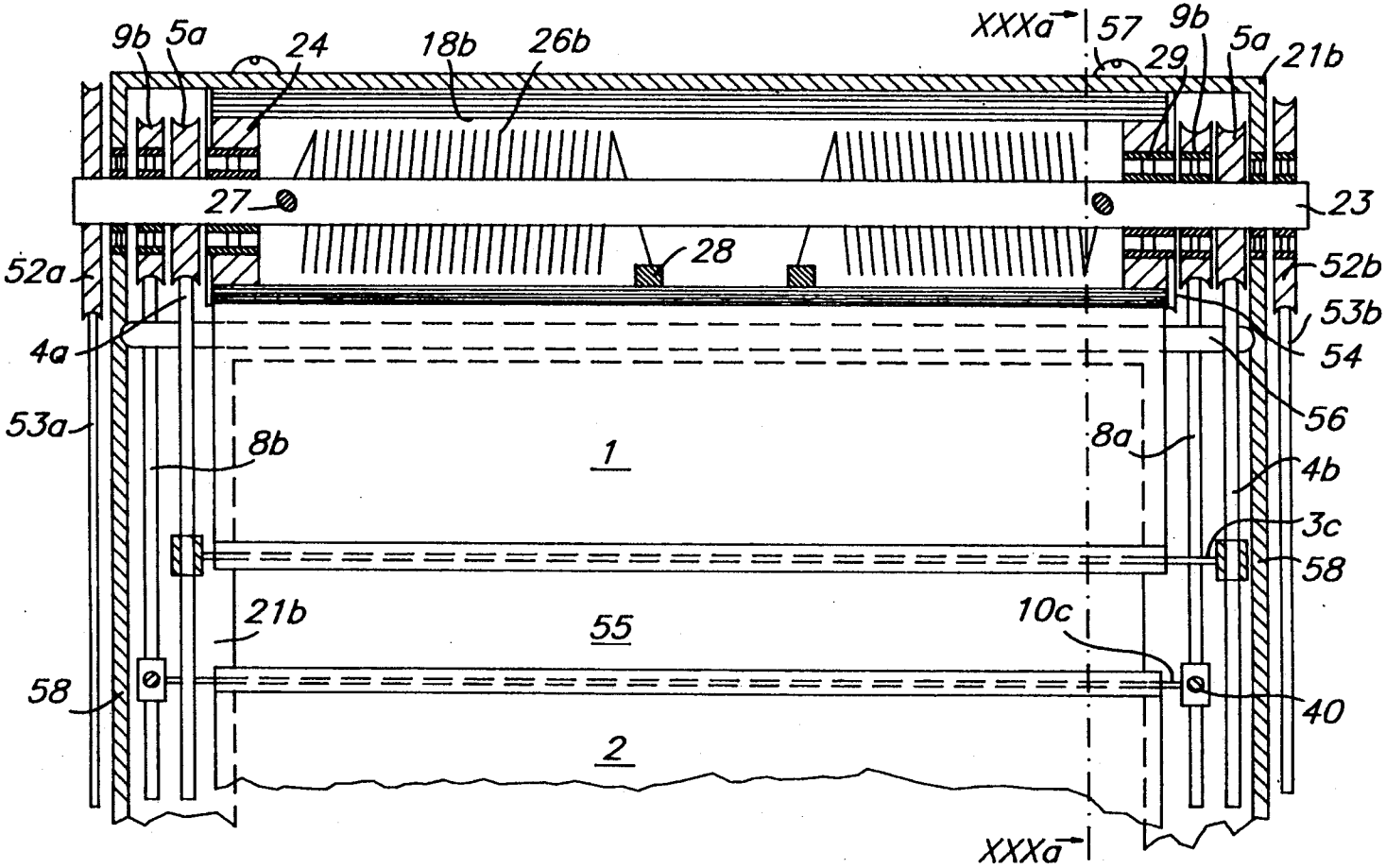

During assembly, the material web of covering 1, 2 is stretched by hand. By fixing the grip bars 3, 10 and end pieces 7, 12 by means of the tapes 4, 8, the tension is maintained, always giving a smooth appearance to the covering. A particular variant for tensioning the covering is shown in FIG. 30. The pulleys 5*a* nonrotatably connected to one another are fastened on a shaft 23, on which a roller 18*b* is also mounted in ball bearings. A coil spring 26*b* is stretched between the roller 18*b* and the shaft 23, so that the covering part 1 is under tension in the winding direction. However, automatic winding cannot take place since the front end of the covering 1 is fastened to the grip bar 3*c*, which is fixed to the tapes 4*a* or 4*b* (for example by screws 40), which in turn are laid, so that they cannot rotate, over the non-slip cover of the pulleys 5*a* with the shaft 23. The tension thus acts only between the grip bar 3*c* and the shaft 23 or the roller 18*b*. Rolling or unrolling of the covering part 1 is possible only by movement of the grip bar 3*c*. This does not change the tension of the spring 26*b*. The visible part of the covering part 1 is therefore always uniformly stretched, regardless of the length pulled out. Such a covering is operated via a pulley 52*a, b* and a continuous belt 53*a, b* guided therein. The pulley 52*a* for part 1 is rigidly connected to the shaft 23, while the pulley 52*b* is rotatably mounted on this shaft. The embodiment for part 2 is laterally inverted. An end pulley 54 guides the rolled-up material web 1. The total mechanism is housed in a frame 21*b*, which is open only in the operating area 55 of the covering parts 1, 2. As can be seen more clearly in FIG. 30*a*, the covering parts 1, 2 and the tapes 4, 8 are guided via a deflecting rod 56 (one above and one below). The thickness of the deflecting rod 56 determines the distance between the parts 1, 2. The frame 21*b* can be suspended from eyes 57, for example, in existing curtain rails. Tensioning of the covering parts 1, 2 is effected by opening the screws 40 in each connected part 58, which is connected to the grip bars 3*c* or 10*c*, or by adjusting the relative position of the parts 1, 2 with respect to the tapes 4, 8. In this tensioning process, the pulley 52 must be fixed, which can be done by means of a fixing screw.

FIG. 16 shows a roller 6 having the pulleys 5 and 9 and the tapes 4 and 8 in detail, and it can clearly be seen that both rollers 6 and pulleys 5, 9 are on one axis.

As already mentioned in part, a second variant of the invention has roller blind-type tensioning springs with rollers 18 or 19 in the form of spring-loaded drums, both for the upper covering part 1 and for the lower one (2), as can be seen in FIG. 17. The spring-loaded drums 18 or 19 endeavour to roll up the covering parts 1*b* or 2*b*, as can be seen more clearly in FIG. 17 and 18.

Figure 19:
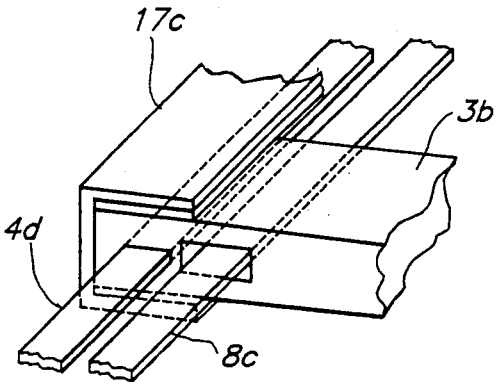
FIG. 19 shows a detail of the lateral guide of the grip bars.

The grip bars 3*b* and 10*a* are each guided laterally in a rail 17*c*, which is lined with felt on its inside, so that the static friction of the grip bars 3*b* and 10*a* in the rail 17*c* is so high that the force of the spring-loaded drums 18 and 19 is not sufficient to roll up the grip bars and hence the doors 1*b* or 2*b* made of material (see FIG. 19). It is only after manual pushing or pulling in the desired direction that the spring-loaded drums 18 or 19 wind or unwind the material webs. In this variant, the tapes 8 and 4 are fastened or guided in the front region, i.e. near the grip bars, in a rail, in exactly the same way as in the first variant. In the rear region, however, there are no end pieces, so that only two rollers 6*a* and 13*a* are provided, at the side of which the pulleys 5 or 9 for the tapes 4 or 8, respectively, are located, as in the first variant (cf. FIG. 16). In this case, the tapes merely perform the function of fixing the grip bars 3*a* or 10*a* in a horizontal position, so that, when they are moved, tilting cannot occur in the guide rail 17. In this case, the pulleys 5 or 9 should not be aligned with the axis of the rollers 6 or 13. As already mentioned, they are mounted in a different place—but are nonrotatably connected to one another. The spring-loaded drums can also have a catch mechanism which prevents independent rolling up (similarly to a roller blind and known, and therefore not shown). The grip bars 3, 10 and the end pieces 7, 12 can in turn be covered with felt or the like in the region where they engage the guide rails 17.

As can also be seen in FIG. 18, the spring-loaded drums 18 or 19 are formed from two drums 25 which are each closed laterally by an end plate 24, which is mounted on a rigid shaft 23 by means of a bearing 29. Inside each drum 25 is a coil spring 26, which is fixed to the spring attachment points 27 on the rigid shaft 23 and the spring attachment points 28 on the inside of the drum 25. A relative rotation of the drum 25 with respect to the rigid shaft 23 thus leads to tensioning or relaxation of the spring 26. The spring 26 has an initial tension in the roll-up direction of the doors 1 or 2 made of roller blind material. If the grip bar is loosened, the associated spring-loaded drum 18 or 19 automatically winds up the covering part.

The diameter of the drum 25 and hence the spring diameter of the coil spring 26 should be kept as large as possible. This prevents the tensile force of the spring 26 from increasing considerably with each revolution. For a material length of about 150 cm for a covering 1 or 2, the circumference of the drum should be 15 to 25 cm, so that about 6 to 10 revolutions are required for completely winding up the covering.

Figure 20:
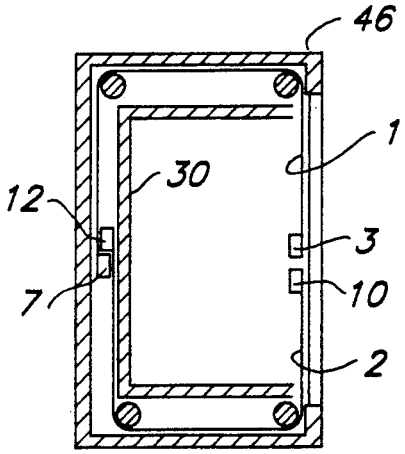
FIGS. 20 to 23 show sectional drawings of various positions of the coverings corresponding to FIGS. 1 to 6.
Figure 21:
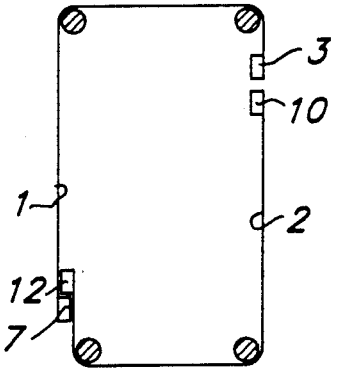
Figure 22:
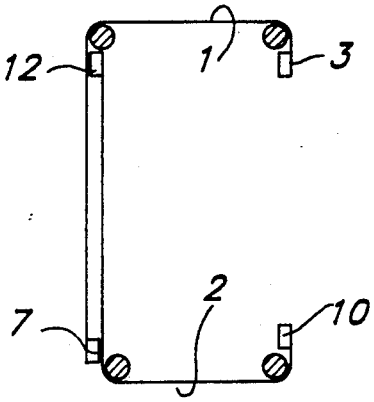
Figure 23:
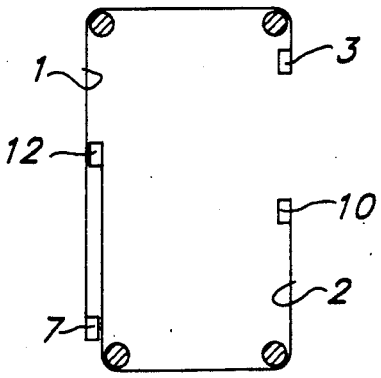

FIG. 20 shows a cover panel 30 which covers the end pieces 7 or 12, or the rear area of the covering parts, so that when the cupboard 46 is loaded, damage to, or contact with, the relevant elements is prevented.

Figure 24:
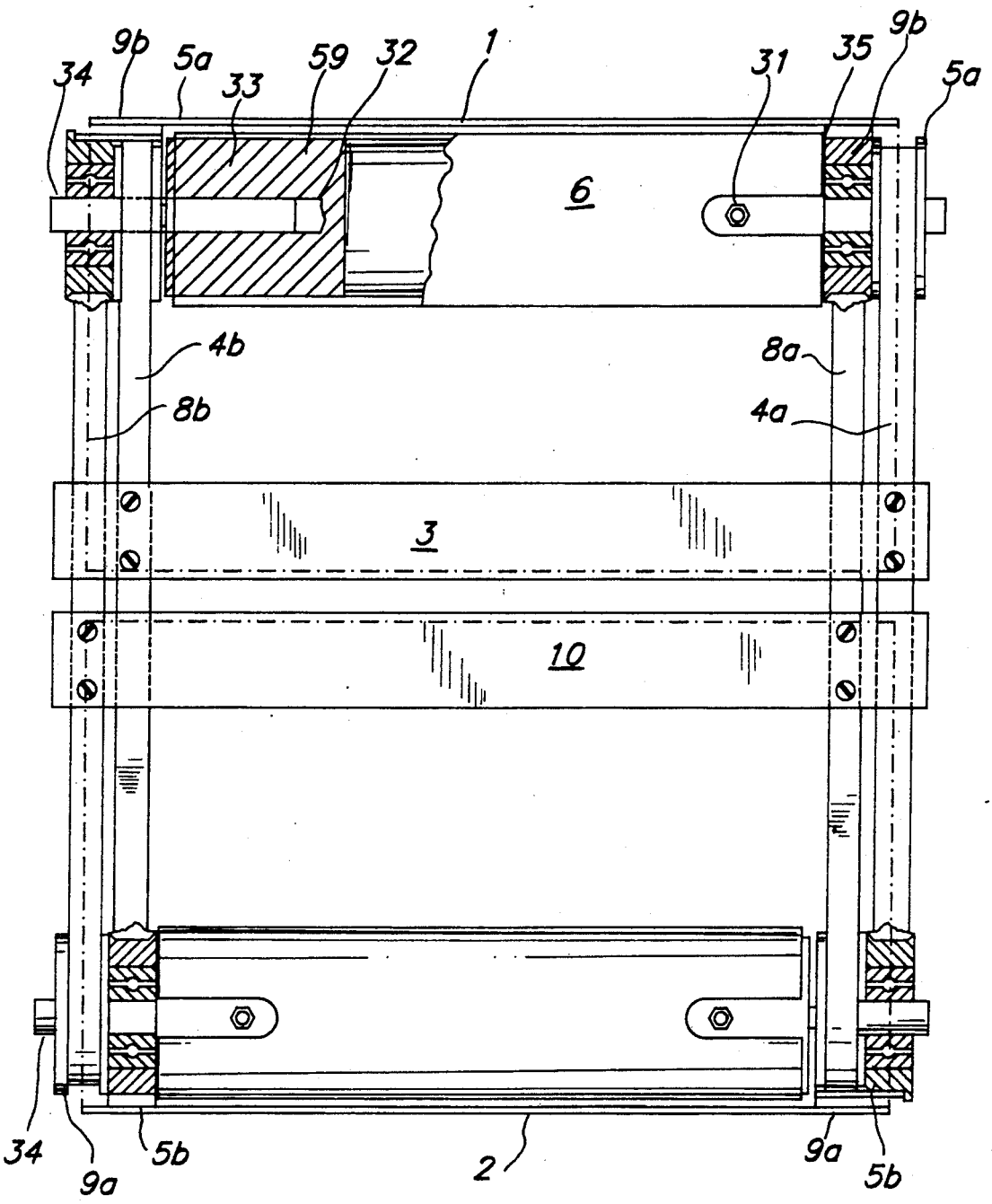
FIG. 24 shows a detailed representation of the roller and pulley construction.

FIG. 24 shows in detail, for a variant, that the pulleys 5*a, b* or 9*a, b* are mounted or fastened on a shaft 34 which has a flange 35 and a pin 33. The flange 35 forms the end of the roller 6 or 13, while the pin 33 rests in a blind hole 32 of the roller 6 or 13. In the blind hole 32, the pin 33 can be displaced in a longitudinal direction and can be fixed by means of a fastening screw 31. This makes it possible to take into account or make various width adjustments. A block 59 serves as a support for the roller 6. Instead of this representation, in a possible variant the block 59, the flange 35 and the shaft 34 can form an integral piece, with the result that the pin 33 is dispensed with and adjustment is effected by means of a screw 31 on the roller circumference.

The pulleys 9*b* are rotatably mounted on the roller 6 or on the shaft 34, while the pulleys 9*a* are rigidly fastened to the roller 13 or to its shaft 34. The converse is true of the pulleys 5*b* and 5*a*. Consequently, when the grip bar 10 is moved via the tapes 5*b*, the roller 13 rotates, the rotation having no effect on the roller 6. As a result, the covering part 2 is moved. The pulleys 9*a* or *b* are fastened or mounted in the opposite sequence, so that movement of the grip bar 3 causes the covering part 1 to move without affecting the roller 13 or the covering part 2. As already mentioned further above, the covering parts 1 or 2 are of course fastened to the grip bars 3 or 10, and the tapes 4*b* or 8*b* to the grip bars 10 or 3—for example, by means of screws or staples. The pulleys 5, 9 are arranged either symmetrically or staggered.

Figure 25A:
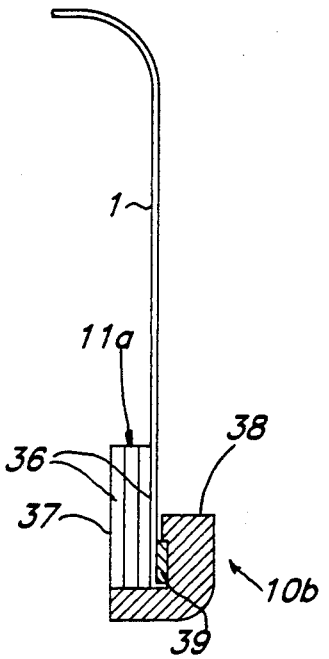
FIGS. 25 and 25*a* show a detailed representation of the grip bar embodiment.
Figure 25:
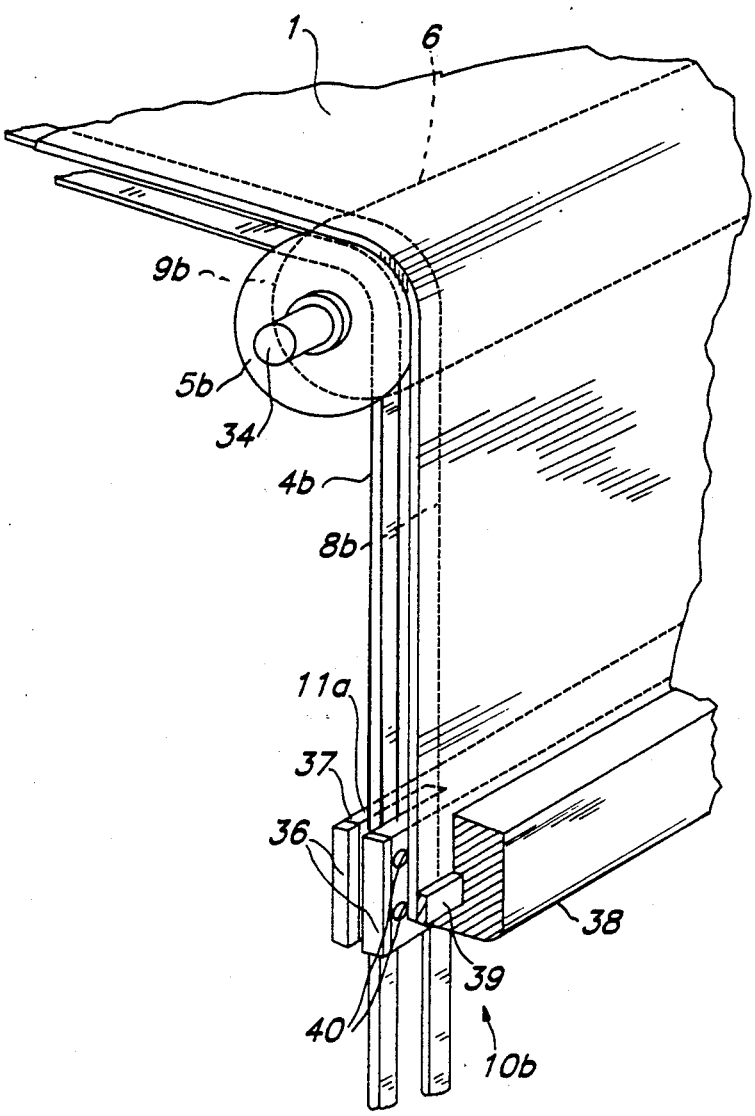

The detailed drawing of FIG. 25 shows that the grip bar 10*b*, like grip bar 3, which is not shown, consists of a transverse bar 37 and a cover strip 38, which are connected to one another, for example, via an adhesive tape 39. The transverse bar 37 has lateral slots 11*a* for the tapes 4*b* or 8*b* and carries on its lateral surfaces a felt 36 for slightly braked gliding in lateral cupboard guides which are not shown. Fastening screws 40 serve to fasten the coordinating tape 4*b*. FIG. 25A shows a side view of the grip bar 10*b*.

The invention is not restricted to the Figures shown and explained by way of example. All grip bars or end pieces, lateral guides, etc. can be made both of wood and of metal or plastic. Furthermore, multilayer coverings can also be provided, so that, in the case of illustrated panels, for example, a large number of different illustrated panels can be displayed, so that, for decoration of a dwelling, for example, coverings of different colors can be chosen. In such cases, a plurality of rollers or pulleys are provided parallel and one on top of the other. This does not change the principle of the invention. In particular, the invention also relates to those variants in which the coverings lie one behind the other (in the direction of the plan view), so that overlapping of the upper and lower parts is possible, with the result that, for example in the case of partial transparence of the front covering parts, special effects result, as can be seen in FIG. 31 and 32.

To support the parallel guidance of the grip bars and/or end pieces, it is also possible for T-shaped lugs on the said grip bars or end pieces to glide in the rails, so that canting is inhibited or prevented by these lugs.

What is claimed is:

1. A covering for covering an opening or lining a surface comprising two covering parts, each of said covering parts comprising a web of flexible material with side edges, tension means at both of said side edges to form said covering part into a continuous closed system, a plurality of pulleys at both of said side edges for guiding said tension means, means for enabling said covering part and said tension means to move independently of the other of said covering parts, and means for fixing said covering part at any desired position, wherein at least two of said plurality of pulleys, one at each of said side edges, are nonrotatably connected to each other, and means provide slip-free transmission of tension from said nonrotatably connected pulleys to said tension means.

2. A covering as claimed in claim 1, wherein said covering parts are moveable in an opening direction and a closing direction and are comprised of material that is elastically stretchable only in said opening direction and substantially non-stretchable at right angles to said opening direction, and said tension means consists of tape means guided on a first group of four of said pulleys to form said closed system, and wherein said slip free transmission means comprises a friction cover on each of said first group of four pulleys.

3. A covering as claimed in claim 1 or 2, further comprising two rollers for guiding said covering part, wherein said nonrotatably connected pulleys are arranged to guide said covering part on said rollers, and other of said pulleys are rotatably mounted independently of each other.

4. A covering as claimed in claim 1, wherein each of said covering parts has a front end with a grip bar and a rear end with an end piece, said grip bars and/or said end pieces have recesses therein, and said tension means associated with one of said covering parts is arranged to glide freely in said recesses in said grip bar or said end piece of the other of said covering parts, said end piece of one of said covering parts being positioned between said end piece and said grip bar of the other of said covering parts.

5. A covering part as claimed in claim 4, further comprising roller means for guiding each of said covering parts, at least one of said roller means being a take-up roller arranged on a shaft remote from said nonrotatably connected pulleys, spring means for subjecting said take-up roller to tension with respect to said shaft in a winding direction, and rail means for laterally guiding said grip bar, wherein said position-fixing-means comprises braking means on said rail means.

6. A covering as claimed in claim 1 or 2, further comprising guide pieces in the form of cylindrical segments with antifriction coatings for guiding said cover parts.

7. A covering as claimed in claim 1, 4 or 5, wherein said tension means is composed of non-stretch material, and further comprising rail means in which said tension means run at least partly, said position-fixing-means comprising lining means in said rail means for braking said grip bar or said end piece.

8. A covering as claimed in claim 3, wherein said tension means is composed of non-stretch material, and further comprising rail means in which said tension means run at least partly, said position fixing means comprising lining means in said rail means for braking said grip bar or said end piece.

9. A covering part as claimed in claim 1, 2, 4 or 5, wherein said covering parts are moveable to an open state and a closed state, further comprising take-up roller means mounted on a shaft for winding up said covering parts to said open state, said take up roller means having tension apparatus between said shaft and said take-up roller means for tensioning said cover parts with respect to said tension means, said non-rotatably connected pulleys being connected to said shaft.

10. A covering as claimed in claim 1 or 2, wherein more than two covering parts are provided, further comprising a moveable frame in which one of said covering parts is mounted, said covering parts having grip bars and end pieces arranged to glide past one another, whereby said covering parts can overlap at least partially.

11. A covering as claimed in claim 1, wherein at least a part of said covering is composed of image reflecting material.

12. A covering as claimed in claim 3, wherein each of said covering parts has a front end with a grip bar and a rear end with an end piece, said grip bars and/or said end pieces have recesses therein, and said tension means associated with one of said covering parts is arranged to glide freely in said recesses in said grip bar or said end piece of the other of said covering parts, said end piece of one of said covering parts being positioned between said end piece and said grip bar of the other of said covering parts.

13. A covering as claimed in claim 2, further comprising a second group of four pulleys for guiding said tape means for a total of eight pulleys, said first group of four pulleys being adjacent one of said covering parts with which they form said closed system and said second group of four pulleys being adjacent the other of said covering parts.

14. A covering as claimed in claim 10, wherein said moveable frame is laterally displaceable in rails relative to said other of said covering parts.

15. A covering as claimed in claim 3, wherein said non-rotatably-connected-pulleys are nonrotatably connected with said roller means, and said independently mounted pulleys are rotatably mounted independently of said roller means.

* * * * *